United States Patent [19]

Gillette

[11] 4,086,460

[45] Apr. 25, 1978

[54] CIRCUIT BREAKER HAVING IMPROVED LINE STRAP CONSTRUCTION

[75] Inventor: Stephen F. Gillette, Rocky Hill, Conn.

[73] Assignee: General Electric Company, New York, N.Y.

[21] Appl. No.: 778,814

[22] Filed: Mar. 17, 1977

[51] Int. Cl.[2] ..... H01H 33/12

[52] U.S. Cl. ..... 200/146 R; 200/144 R; 200/147 R

[58] Field of Search ..... 200/146 R, 144 R, 147 R

[56] References Cited

U.S. PATENT DOCUMENTS

| | | | |
|---|---|---|---|
| 3,118,036 | 1/1964 | Gauthier et al. | 200/147 R |
| 3,589,329 | 6/1971 | Walker et al. | 200/146 R |
| 3,749,867 | 7/1973 | Rexroad | 200/144 R |
| 3,784,775 | 1/1974 | Gryctko | 200/146 R |

*Primary Examiner*—Robert S. Macon

*Attorney, Agent, or Firm*—Robert A. Cahill; Walter C. Bernkopf; Frank L. Neuhauser

[57] ABSTRACT

A longitudinally elongated, planar line strap for circuit breakers mounts on its upper surface adjacent one end a pair of transversely aligned, spaced apart main contacts. An arcing contact is mounted on a lanced-up portion of the strap joined to the strap body at a location intermediate the main contacts. An elongated arc runner is cantilever mounted to the free end of the lanced-up strap portion for extension out into an arc chute. The current in the strap flows along paths effective to motivate an arc off the main contacts and out onto the arcing contact and thence the arc runner where it is captured by the arc chute.

10 Claims, 5 Drawing Figures

CIRCUIT BREAKER HAVING IMPROVED LINE STRAP CONSTRUCTION

BACKGROUND OF THE INVENTION

Industrial circuit breakers in the larger current ratings are typically provided with plural sets of movable and stationary main contacts, as well as a set of movable and stationary arcing contacts in each breaker pole. The movable main contacts are individually mounted by separate pivotal arms, while the movable arcing contact is mounted by yet another pivotal arm of somewhat greater length such that the movable arcing contact can engage its stationary counterpart positioned within the entry portion of an arc chute. The main and arcing contact arms are ganged together by a carrier which, in turn, is ganged with the movable contact arm carriers of the other breaker poles by a crossbar. The breaker operating mechanism is typically linked to the center pole contact arm carrier pursuant to achieving concerted movements of the movable contacts of all the breaker poles between open and closed circuit positions with respect to their associated stationary contacts.

The movements of the movable main and arcing contacts are preferably coordinated such that, during a circuit interruption, the main contacts separate before the arcing contacts. This is done to transfer at least a major portion of the current to the arcing contacts such that upon their separation an arc will be drawn between the arcing contacts and any arcing at the main contacts will then abruptly terminate. Since this ideally locates the arc well within the entry portion of the arc chute, arc extinction can be readily effected.

Unfortunately, particularly in the case of the high fault current interruptions, major transfer of the current to the still closed arcing contacts does not occur, and consequently substantial arcing at the main contacts cannot be avoided. In fact, the arc drawn between the main contacts as they separate can become so well established that it just stays there, and little or no arcing occurs between the arcing contacts upon their separation. Since the main contacts are not located in the entry portion of the arc chute and thus do not have the benefit of its arcing extinguishing capabilities, the arc can and indeed does considerably damage the main contacts and adjacent conductive parts which are not designed to withstand prolonged arc rooting.

This problem is well recognized and numerous approaches have been proposed with varying degrees of success to move the arc from the main contacts out to the arcing contacts. For example, sources of gases have been utilized to blow the arc off the main contacts. Separate magnetic blowout coils to develop electromotive forces propelling the arc off the main contacts have also been utilized. Both of these approaches, while generally successful, are typically expensive to execute. Elaborate structuring of the circuit breaker internal circuit has been proposed to route the fault current feeding the arc along prescribed paths calculated to develop electromotive forces propelling the arc off of the main contacts. This approach invariably requires an expensive circuit breaker redesign. Another proposal involving the provision of a magnetic arc runner located between the stationary main and stationary arcing contacts for the purpose of attracting the arc off the main contacts, while inexpensive to implement, has not been found to be particularly successful.

It is accordingly an object of the present invention to provide a circuit breaker which is equipped with means for minimizing arcing at its main contacts.

A further object is to provide a circuit breaker of the above character wherein the arc drawn between the main circuit breaker contacts is effectively and expeditiously transferred to the arcing circuit breaker contacts.

Yet another object of the present invention is to provide a circuit breaker of the above-character, wherein the transfer of the arc from the main to the arcing contacts is propelled by the magnetic fields associated with the currents feeding the arc.

An additional object is to provide a circuit breaker of the above character which includes a line strap for mounting the stationary main and arcing contacts and wherein the line strap is uniquely structured to route the current feeding an arc drawn between the main contacts in a manner to develop electromotive forces propelling the arc off the main contacts and out onto the arcing contacts.

Still another object is to provide a circuit breaker of the above character wherein the uniquely structured line strap of the present invention is inexpensive to produce and can be implemented without redesigning the remainder of the circuit breaker.

Other objects of the invention will in part be obvious and in part appear hereinafter.

SUMMARY OF THE INVENTION

In accordance with the present invention, there is provided a molded case circuit breaker having in each of its poles at least a pair of movable main contacts and a single movable arcing contact all mounted for movement into and out of engaging relation with associated stationary main and arcing contacts. A longitudinally elongated, planar line strap, mounted within the case for each breaker pole, has a terminal end portion protruding from the case to facilitate external electrical circuit connection. The pair of stationary main contacts are mounted in transversely aligned, spaced apart relation on the upper surface of the line strap adjacent its inner end opposite its terminal end. Somewhat spaced from its inner end, a central portion of the line strap is lanced up; this lanced-up portion being joined to the body of the strap at a location intermediate the stationary main contacts. The stationary arcing contact is mounted on this lanced-up strap portion, while an elongated magnetic arc runner is cantilever mounted to the free end of the lanced-up strap portion for extension out into an arc chute stationed above the line strap intermediate its ends.

By virtue of this line strap construction, the current flow in the strap splits into two longitudinal paths upon encountering the opening in the strap created by the striking of the lanced-up portion from the strap body. Each current path feeds a different one of the main stationary contacts. During a high fault current interruption, the arcs initially rooting on the two main stationary contacts essentially combine into a single large arc column rooting on the line strap surface at a location generally intermediate the main contacts. Thus the current in the line strap feeding this arc column, after splitting into separate paths around the strap opening, flows along generally transverse paths converging on the arc column root intermediate the main contact locations. The magnetic fields associated with the currents in these transverse paths interact with the arc, to develop a resultant electromotive force propelling the arc column longitudinally of the line strap. To ensure that the resultant of this electromotive force is directed outwardly toward the arcing contact, the inner end edge of the line strap intermediate the main contacts is notched to cause the transverse current paths to curl and thus converge on the arc column root somewhat longitudinally from the inner end of the line strap. As the arc column root is moved up onto the lanced-up strap portion leading to the arcing contact, the currents in the transverse paths combine into a single generally longitudinal path aligned with the direction the arc column is to be moved. This increases the resultant electromotive force acting on the arc column, and the arc column root is effectively propelled or "motored" out onto the arcing contact and thence along the arc runner where the arc column can be extinguished by the arc chute. As a consequence, the arc column is effectively prevented from rooting at one location on the main contacts or the line strap itself for any prolonged interval, and thus arc erosion of these parts is minimized.

The invention accordingly comprises the features of construction, combination of elements and arrangement of parts which will be exemplified in the construction hereinafter set forth, and the scope of the invention will be indicated in the claims.

For a fuller understanding of the nature and objects of the invention, reference should be had to the following detailed description taken in connection with the accompanying drawings, in which.

Like reference numerals refer to corresponding parts throughout the several views of the drawings.

DETAILED DESCRIPTION

Figure 1:
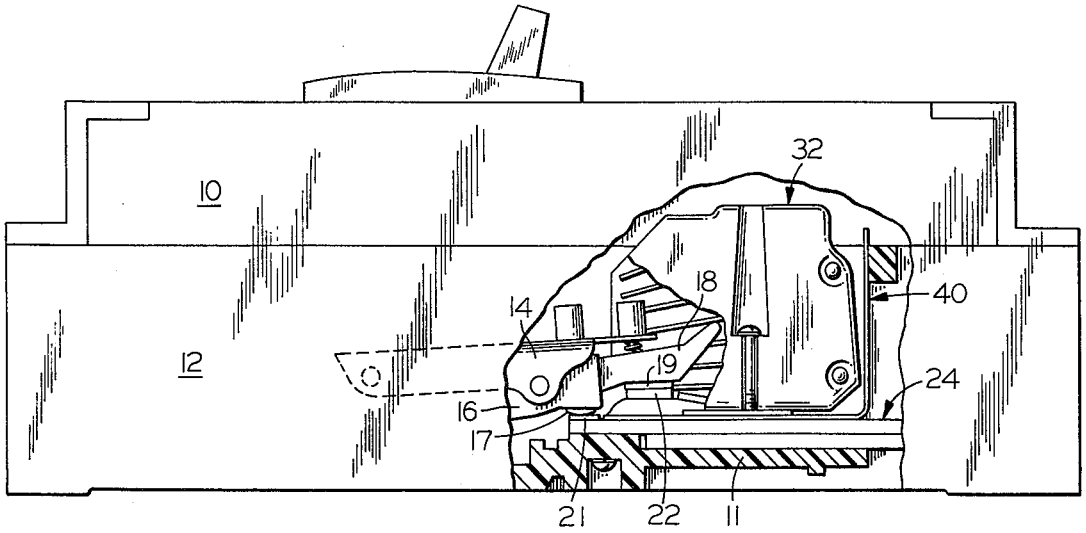
FIG. 1 is a side elevational view, partially broken away, of a molded case circuit breaker embodying line straps constructed in accordance with the present invention.

The present invention is embodied in a multi-pole industrial circuit breaker including, as seen in FIG. 1, a molded case consisting of a base 10 and a cover 12. In each pole of the circuit breaker there is provided a carrier 14 which is ganged together with the carriers in the other breaker poles by a crossbar (not shown) for concerted pivotal movement between closed and open circuit positions. Each carrier mounts a pair of short contact arms, one being seen at 16 in FIG. 1, which flank an elongated contact arm 18. Each short contact arm 16 carries a movable main contact 17, while the longer contact arm carries a movable arcing contact 19. The movable contact assemblies may be constructed in the manner more clearly illustrated in U.S. Pat. No. 3,263,051, which is assigned to the assignee of the present invention.

Figure 4:
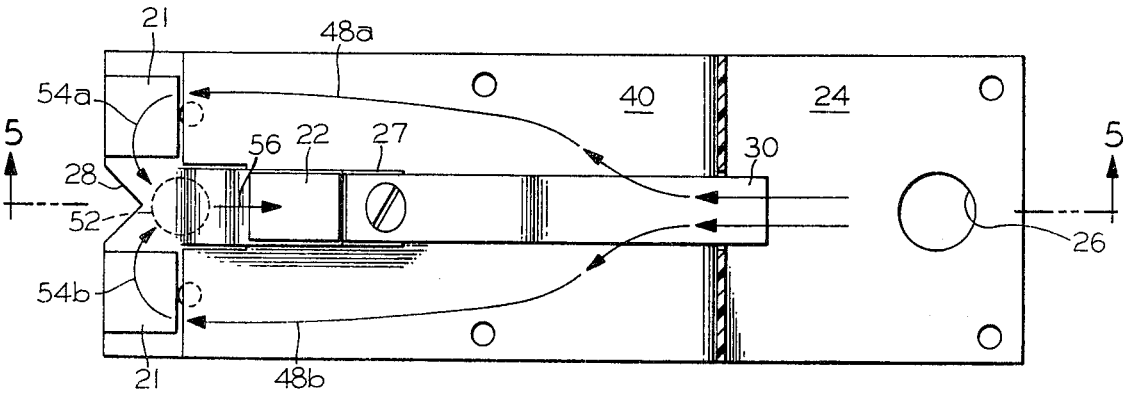
FIG. 4 is a plan view of one of the line straps utilized in the circuit breaker of FIG. 1.
Figure 5:
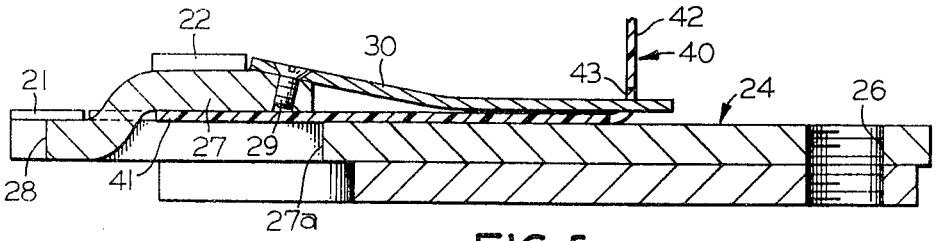
FIG. 5 is a sectional view taken along line 5—5 of FIG. 4.

In their closed circuit positions, the movable main contacts 17 and the movable arcing contact 19 of each contact assembly individually engage associated stationary main contacts 21 and a stationary arcing contact 22, which are mounted adjacent the inner end of a line strap, generally indicated at 24 and secured in each breaker pole to the floor 11 of the breaker case. As best seen in FIGS. 4 and 5, each line strap 24 of the circuit breaker of FIG. 1 is, according to the present invention, in the form of a longitudinally elongated, rectangular plate composed of a suitable electrically conductive metal, such as copper. As seen in FIG. 5, the line straps may be formed of two copper plates brazed together for increased current carrying capacity. The right end of each line strap extends into a terminal recess (not shown) provided in the breaker case so as to be accessible for external electrical circuit connection. A threaded bore 26 may be provided in the line strap adjacent its right end for receipt of a bolt serving to clamp a cable lug (not shown) in electrical connection with the strap.

Figure 2:
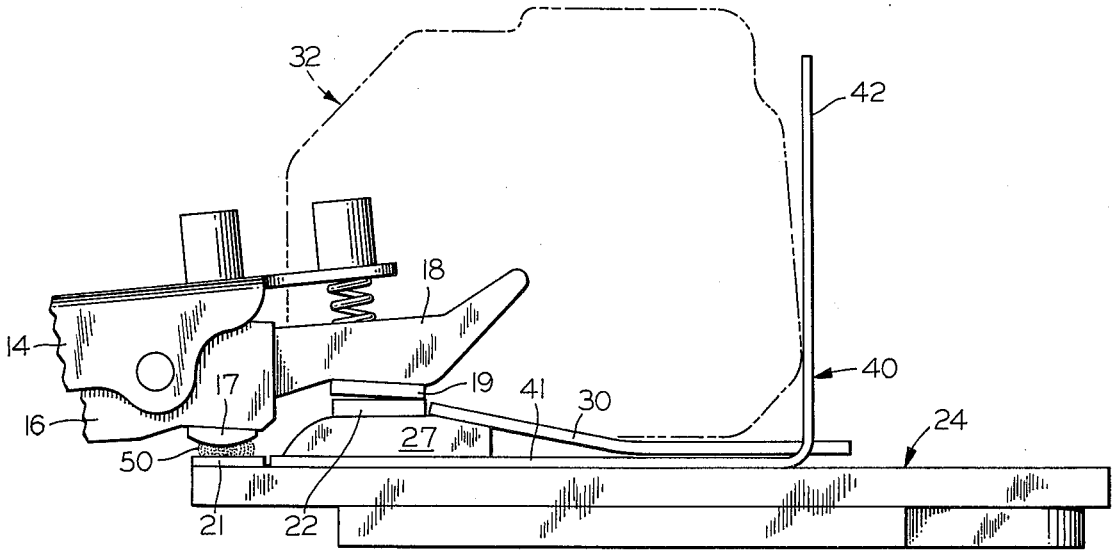
FIG. 2 is a fragmentary side elevational view of the circuit breaker of FIG. 1 taken during the initial stage of a circuit interruption with the main contacts separated, but the arcing contacts still in engagement.
Figure 3:
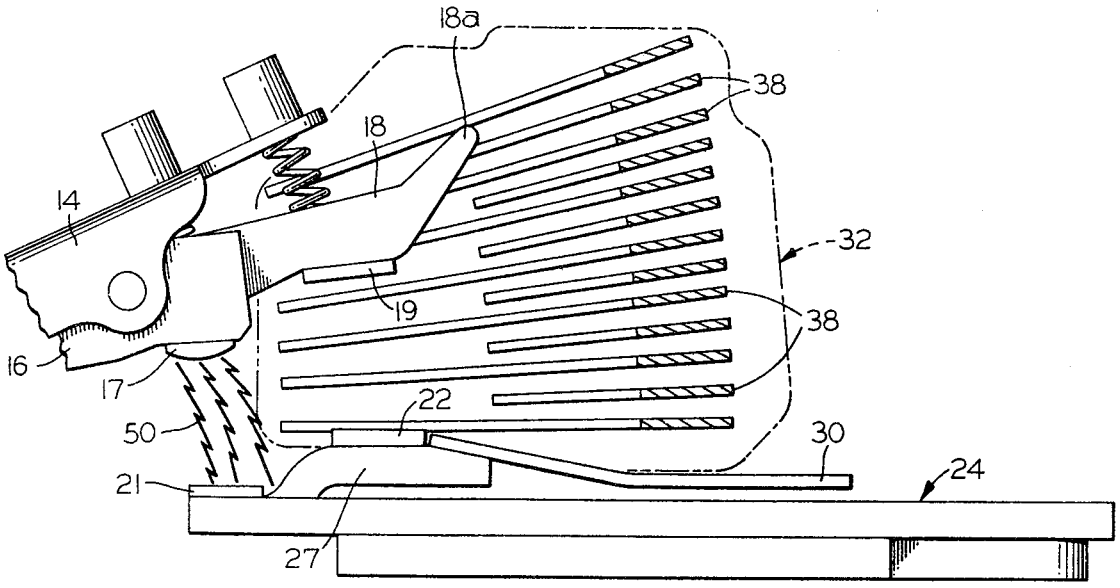
FIG. 3 is a fragmentary side elevational view, partially broken away, of the circuit breaker of FIG. 1 taken during an intermediate stage of a circuit interruption with both the main and arcing contacts separated.

The two stationary main contacts 21 are affixed to the upper surface of the line strap in transversely aligned, spaced apart locations in the corners at the left end of the strap. The stationary arcing contact 22 is mounted atop a rigid lanced-up portion 27 struck from the body of line strap 24. This lanced-up portion is joined to the strap body along the transverse edge of the opening **27*a* intermediate the main contacts which was created by the striking of the lanced-up portion. The edge of the left end of strap 24 is provided at a location intermediate the main contacts with a V-shaped notch 28 whose apex is pointed toward lanced-up portion 27. Just beyond the arcing contact 22, a screw 29 is threaded into a tapped bore formed in the lanced-up portion 27 to cantilever mount a magnetic arc runner 30 for extension toward the right terminal end of the line strap. A conventional arc chute, generally indicated at 32 in FIGS. 1–3, is positioned within the breaker case in overlying relation to each line strap 24 and arc runner 30. The arc chute includes a stack of magnetic plates 38 which interact with the magnetic field of a contiguous arc to draw the arc into contact with the plates where it is cooled pursuant to de-ionizing the arc path leading to ultimate arc extinction. An L-shaped sheet of insulative material, generally indicated at 40 in FIGS. 1, 2 and 5, has a horizontal segment 41 which lies atop the line strap 24. The left end of this segment terminates just short of the main contacts and is slotted to clear the lanced-up strap portion as it curves down into joinder with the strap body. The upright segment 42 of the insulative sheet is positioned just behind the arc chute and is suitably perforated to accommodate the passage of arc gases exhausting out the back of the arc chute. The arc runner 30 extends through an opening 43 provided in the L-shaped insulative sheet 40** at its bend.

By virtue of the above-described strap construction, the current flowing in the line strap between the stationary main contacts 21 and the terminal end of the line strap divides into two parallel paths, indicated diagrammatically at **48*a* and 48*b* in FIG. 4, around the opening 27*a* in the strap body. When the circuit breaker of FIG. 1 operates to effect a circuit interruption, the main contacts separate in advance of the arcing contacts, as is illustrated in FIG. 2, and arcs, indicated at 50, are drawn between the two sets of main contacts as they separate. If an exceptionally high fault current is flowing in the circuit being interrupted, it is found that substantial transfer of the current to the arcing contacts does not occur. Consequently the arcs remain on the main contacts, and little or no arcing occurs at the arcing contacts as they separate (FIG. 3). The separate arcs drawn between the two sets of main contacts essentially combine into a single large arc column rooted at its lower end to the line strap surface over the region generally indicated by the phantom circle 52 in FIG. 4. To feed this arc column, the currents flowing in the split paths 48***a* and 48*b* in the line strap must, in effect, turn the corners and converge on the arc column root transversely from each side of the line strap, as indicated diagrammatically at 54*a* and 54*b* . The presence of notch 28 in the end edge of the line strap causes these transverse current paths to curl away from the left edge of the line strap such as to arrive at the arc column root 52 somewhat from behind the arc column.

The electromagnetic field associated with the currents flowing in these transverse paths interact with the arc current to develop a resultant electromotive force propelling the arc in the direction of the lanced-up strap portion, as indicated by arrow 56. As the arc root 52 moves up onto the lanced-up strap portion, the currents in the transverse paths combine into a single path flowing to the arc root from generally behind the arc. The resultant electromotive force acting to propel the arc to the right in the direction of arrow 56 is thus increased, and the lower arc route moves onto the stationary arcing contact 22. Since the arc column will strive to achieve the shortest possible path length, the upper root of the arc column will move out along the under surface of arcing contact arm 18 to the movable arcing contact 19, thus completing the transfer of the arc from the main contacts to the arcing contacts.

The path of the arc is now within the entry portion of the arc chute proximate the arc plates, and the interaction between the magnetic field associated with the arc current and the magnetic arc plates is strong enough to attract the arc into contact with the arc plates. Also, the directions of the current paths in the strap 24 and the contact arm 18 are such that their associated magnetic fields assist in motivating the arc into the arc chute plates by propelling the lower arc root out onto arc runner 30 and the upper arc root out onto a horn 18*a* carried at the free end of arm 18. The presence of the segment 41 of insulative sheet 40 in overlying relation with upper surface of strap 24 serves to confine the lower arc column root to the region 52, lanced-up portion 27, arcing contact 22 and arc runner 30. Any attempt by the arc column to root on the insulative sheet, which is preferably formed of a gas ablative material such as vulcanized fiber, is discouraged by the gases evolving from the sheet during the presence of an arc.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described my invention, what I claim as new and desire to secure by Letters Patent is:

1. A circuit breaker comprising, in combination:

A. at least one longitudinally elongated planar, conductive strap having a first end and a second end adapted for external electrical circuit connection;

B. a pair of stationary main contacts mounted on the upper surface of said strap adjacent its first end in transversely aligned, spaced apart relation;

C. means forming an opening in said strap adjacent its first end;

D. a rigid conductive member joined at one end to said strap along a transversal edge of said opening located intermediate said main contacts for cantilevered extension in spaced relation to said strap toward its second end;

E. a stationary arcing contact mounted on the upper surface of said conductive member;

F. a contact assembly including a pair of movable main contacts and a movable arcing contact movable into and out of engagement with said stationary main and arcing contacts; and G. an arc chute positioned over said strap in proximity with said movable and stationary arcing contacts.

2. The circuit breaker defined in claim 1, which further includes means forming a V-shaped notch in an edge of said strap at a location intermediate said stationary main contacts.

3. The circuit breaker defined in claim 1, wherein said member has a free end portion disposed out of the plane of said strap.

4. The circuit breaker defined in claim 3, which further includes an elongated magnetic arc runner cantilever mounted to said free end portion of said member for extension in spaced relation between said strap and said arc chute.

5. The circuit breaker defined in claim 4 which further includes a sheet of insulative material overlying said strap, said sheet being relieved to expose said stationary main contacts and the portion of the strap upper surface intermediate said stationary main contacts.

6. The circuit breaker defined in claim 3, wherein said opening and said member are created by lancing said member up from the body of said strap.

7. The circuit breaker defined in claim 6, which further includes means forming a V-shaped notch in an edge of said strap at a location intermediate said stationary main contacts.

8. The circuit breaker defined in claim 6, which further includes an elongated magnetic arc runner cantilever mounted to said free end portion of said member for extension in spaced relation between said strap and said arc chute.

9. The circuit breaker defined in claim 7, which further includes an elongated magnetic arc runner cantilever mounted to said free end portion of said member for extension in spaced relation between said strap and said arc chute.

10. The circuit breaker defined in claim 9 which further includes a sheet of insulative material overlying said strap, said sheet being relieved to expose said stationary main contacts and the portion of the strap upper surface intermediate said stationary main contacts.

* * * * *